US007603995B2

(12) United States Patent
Wood

(10) Patent No.: US 7,603,995 B2
(45) Date of Patent: Oct. 20, 2009

(54) BOLT WITH REDUCED IMPACT TO INCOMING PROJECTILE

(75) Inventor: Jack Kingsley Wood, Chesire (GB)

(73) Assignee: Planet Eclipse Limited, Trafford Park, Manchester (GB)

( * ) Notice: Subject to any disclaimer, the term of this patent is extended or adjusted under 35 U.S.C. 154(b) by 0 days.

(21) Appl. No.: 11/846,938

(22) Filed: Aug. 29, 2007

(65) Prior Publication Data

US 2008/0053423 A1 Mar. 6, 2008

Related U.S. Application Data

(60) Provisional application No. 60/824,645, filed on Sep. 6, 2006.

(51) Int. Cl.
*F41B 11/00* (2006.01)

(52) U.S. Cl. ..... 124/73; 124/63; 124/56; 124/77; 124/74; 124/72; 124/32

(58) Field of Classification Search ..... 124/56, 124/65, 73, 77, 74, 71, 41.1, 72, 32; 42/69.02, 42/84

See application file for complete search history.

(56) References Cited

U.S. PATENT DOCUMENTS 3,090,151 A * 5/1963 Stewart et al. ..... 43/6
2003/0034020 A1* 2/2003 Irizarry et al. ..... 124/56
2005/0115550 A1* 6/2005 Jones ..... 124/65
2007/0151549 A1* 7/2007 Wood ..... 124/73
2007/0209650 A1* 9/2007 Jones ..... 124/73
2008/0099005 A1* 5/2008 Kaakkola et al. ..... 124/74

* cited by examiner

*Primary Examiner*—Michael Carone
*Assistant Examiner*—Samir Abdosh
(74) *Attorney, Agent, or Firm*—Barlow, Josephs & Holmes, Ltd.

(57) ABSTRACT

An improved bolt construction for use in a paintball marker assembly is provided. The improved bolt assembly is generally formed to include a cut-out in the top surface thereof along its leading edge. The cut-out has a size and shape that functions in an manner that prevents the bolt from clipping or otherwise damaging a second incoming paintball projectile as the bolt reciprocates forward to ready a first paintball that is already loaded into the breech in preparation for launch. As the bolt is moved forward to push the first paintball into a position that is ready for launch, the leading edge of the cutout passes beneath the second paintball such that the top surface of the cutout impacts the bottom of the second paintball to push the second paintball upwardly as it advances, thereby clearing it from the breech and preventing the bolt from clipping the second paintball.

8 Claims, 5 Drawing Sheets

BOLT WITH REDUCED IMPACT TO INCOMING PROJECTILE

CROSS-REFERENCE TO RELATED APPLICATIONS

This application is related to and claims priority from earlier filed U.S. Provisional Patent Application No. 60/824,645, filed Sep. 6, 2006.

BACKGROUND OF THE INVENTION

1. Field of the Invention

The present invention generally relates to pneumatic projectile launchers such as paintball markers. More specifically, the present invention relates to a new bolt configuration for use in a pneumatic projectile launcher that enhances the launching of projectiles, such as paintballs, therefrom.

2. Description of the Related Art

In the prior art, pneumatic projectile launchers, i.e. guns that employ compressed gas to launch a projectile, such as is the case in paintball markers, are relatively well known. In general, these devices include a supply of compressed gas that fills a chamber, which, upon pulling of a trigger, is then emptied into the paintball marker barrel to launch a projectile, namely, a paintball. Within the paintball marker, valving is typically provided that operates in response to the trigger in order to selectively control the flow of gas therein. As can be seen In FIG. 1*a*, paintball markers typically employ a bolt system 10 that controls the loading and launching of one projectile 12*a* at a time by removing them from a projectile storage compartment 14. For example, hoppers and autoloaders are commonly used in connection with paintball markers to store a large number of projectiles, such as paintballs. Such hoppers and autoloaders also include a feed system that operates by gravity or other known arrangements in a manner that feeds the projectiles in rapid succession into the breech 16 of the marker in preparation for loading and launching as described above.

As is well known in the art, paintballs are formed to include an outer skin that is filled with a colored liquid. In operation, the outer skin is intended to burst and release the colored liquid upon impact with a desired target. In order to function properly, the outer skin of the paintball must be relatively delicate, giving rise to a concern related to the manner in which the paintballs are handled by the various operational parts of the paintball marker. Specifically, there is a desire that the paintballs not burst within the paintball marker during the launching process and before they impact the target.

Also, there is a desire in the paintball marker industry to build markers that have ever increasing firing rates. In this regard, the more rapidly and smoothly successive paintballs are fed into the marker breach, the shorter the cycle time of the marker is and the faster the firing rate of the marker. In other words, the faster the paintball is ready for launch, the faster the gas can be released to launch the paintball. This successive rapid firing of paintballs requires that each of the paintballs being loaded must be positioned very close to one another during the loading process. Turning back to FIGS. 1*a* and 1*b*, once a first paintball 12*a* drops into the breech 16 of the prior art marker, a bolt 10 is employed to move that paintball 12*a* forward into the barrel 18 to complete the loading process in preparation for launch using the compressed gas. The faster cycle times, which are employed for improved rapid launching, require the bolt 10 to reciprocate extremely fast between a rearward position where a projectile paintball 12*a* can be received into the breech 16 to a forward position where the projectile paintball 12*a* is forward in a position ready for launch.

Such high-speed reciprocation of the bolt 10 can in turn result in serious problems with the operation of the paintball marker. The problems arise principally due to the manner in which the paintballs 12*a* are fed to the marker. As the paintballs 12*a* are gravity fed to the breech 16, successive paintballs 12*b*, 12*c* are typically touching each other during the loading process. For example, it is well known that a second paintball 12*b* may be touching a first paintball 12*a* that has already dropped into the breech 16. This arrangement however creates a problem in that the second paintball 12*b* is partially in the breech 16 on top of the first paintball 12*a*, even though it is not the paintball that is intended for launch. As a result, it is a well-known problem that the top edge of a bolt 10 can clip the bottom portion of the second paintball 12*b* in the region depicted by the dotted line of FIG. 1*b* as the bolt 10 is moving forward to prepare the first paintball 12*a* for launch. Should the bolt 10 clip the second paintball 12*b*, pieces of the outer shell of the second paintball 12*b* may cause the marker to jam. Even worse, the clipped paintball 12*b* may actually burst within the breech 16. Further, even if the second paintball 12*b* is not nicked or broken, the impact of the bolt 10 may weaken the outer shell of the second paintball 12*b*. Once the shell of the second paintball 12*b* has been weakened, the forces exerted to fire the second paintball 12*b* once it is loaded may exploit the weakness causing it to rupture in the barrel 18 during firing. As can be understood, this is highly undesirable because it can render the marker inoperable.

In view of the foregoing, there is a need for an improved paintball marker construction that is configured to avoid damage to a second incoming paintball during the bolt movement that prepares a first paintball for launch within the marker breech. There is also a need for an improved paintball marker bolt system that can maintain a seal within the breech while also avoiding damage to a second incoming paintball.

SUMMARY OF THE INVENTION

In this regard, the present invention provides for an improved bolt construction for use in a paintball marker assembly. The improved bolt assembly for a paintball marker of the present invention is generally formed in an manner that prevents the bolt from clipping or otherwise damaging a second incoming paintball projectile as the bolt reciprocates forward to ready a first paintball that is already loaded into the breech in preparation for launch. As was stated above, as the paintballs are fed into the breech of the paintball marker using a variety of feed mechanisms such as gravity fed and force fed loaders. During the feed process the first paintball drops into the breech with the second subsequent paintball sitting on the top of the first paintball. As a result, the bottom portion of the second paint ball is also partially within the breech opening.

To prevent the prior art result of clipping the bottom of the second paintball, the bolt of the present invention has a cutout out in the top portion thereof along its leading edge. The cutout is ramped such that it is deeper at the leading edge and tapers to nothing at its trailing edge. As the bolt of the present invention is moved forward to push the first paintball into a position that is ready for launch, the leading edge of the cutout passes beneath the second paintball such that the top surface of the cutout impacts the bottom of the second paintball. This can be contrasted with the prior art depicted at FIG. 1 wherein the flat face at the front of the bolt impacted the side of the paintball. In this manner, the ramped surface of the cutout on the bolt of the present invention displaces the second paintball upwardly as it advances, thereby clearing it from the breech and preventing the bolt from clipping the second paintball. The utility of the bolt of the present invention is particularly highlighted when used in connection with force feed loaders because the issue of bolt impact exacerbated by force feed loaders in that the second paintball is being urged downwardly and retained in the path of the bolt by the force of the feeder.

It can also be appreciated that the leading end of the bolt must serve to seal the rear of the barrel preventing the compressed launch gas from escaping rearwardly. In this regard, O-rings are provided adjacent the leading end of the bolt that seal the gap between the bolt and the breach as the bolt is moved into a closed position. To prevent the O-rings from interfering with the newly provided cut-out on the top of the bolt, recess cuts are provided beneath the O-rings to allow the O-rings to deflect downwardly as the bolt passes beneath the second paintball.

It is therefore an object of the present invention to provide an improved paintball marker construction that is configured to avoid damage to a second paintball during the bolt movement that prepares a first paintball for launch within the marker breech. It is a further object of the present invention to provide an improved paintball marker bolt system that can maintain a seal within the breech while also avoiding damage to a second paintball as the bolt is cycled to ready a first paintball for launch.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1A:
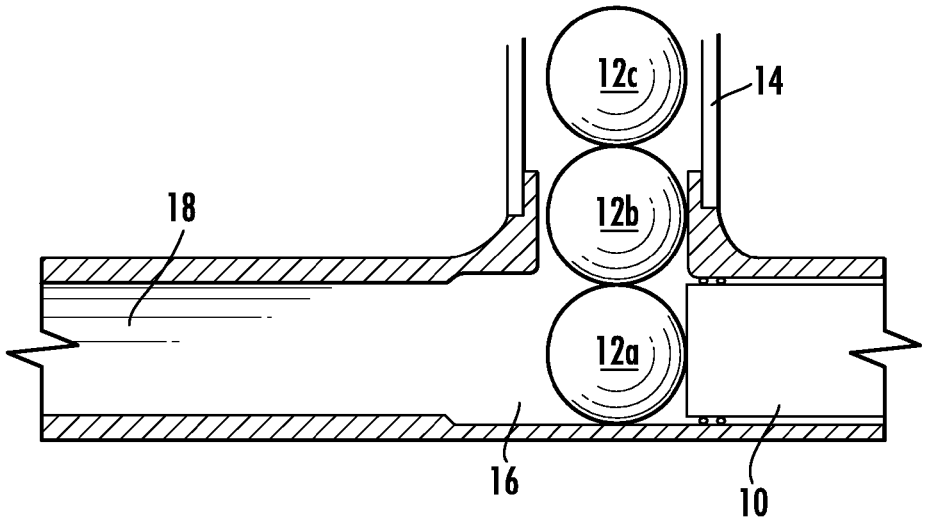
FIG. 1a (PRIOR ART)
FIG. 1*a* is a cross sectional view of a prior art paintball marker with the bolt in a rearward position.
Figure 1B:
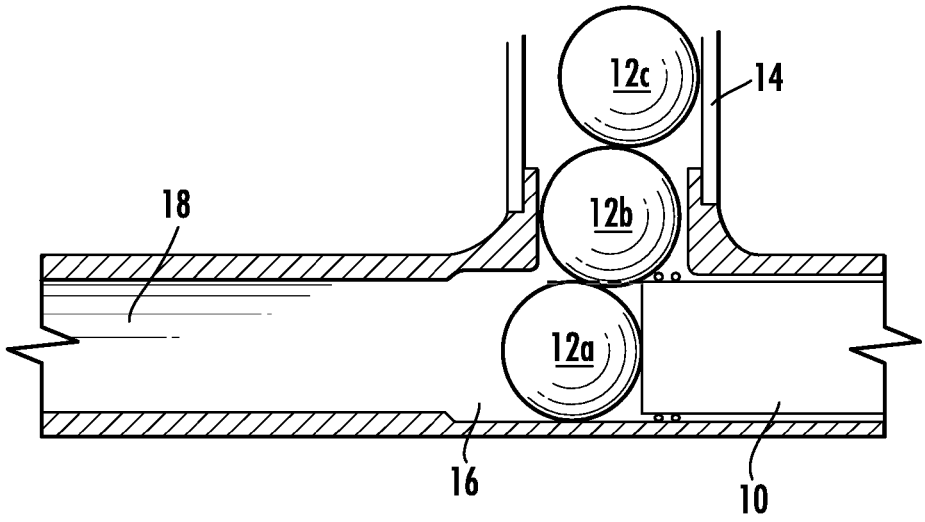
FIG. 1b (PRIOR ART)
FIG. 1*b* is a cross sectional view of a prior art paintball marker with the bolt traveling to a closed position.
Figure 2:
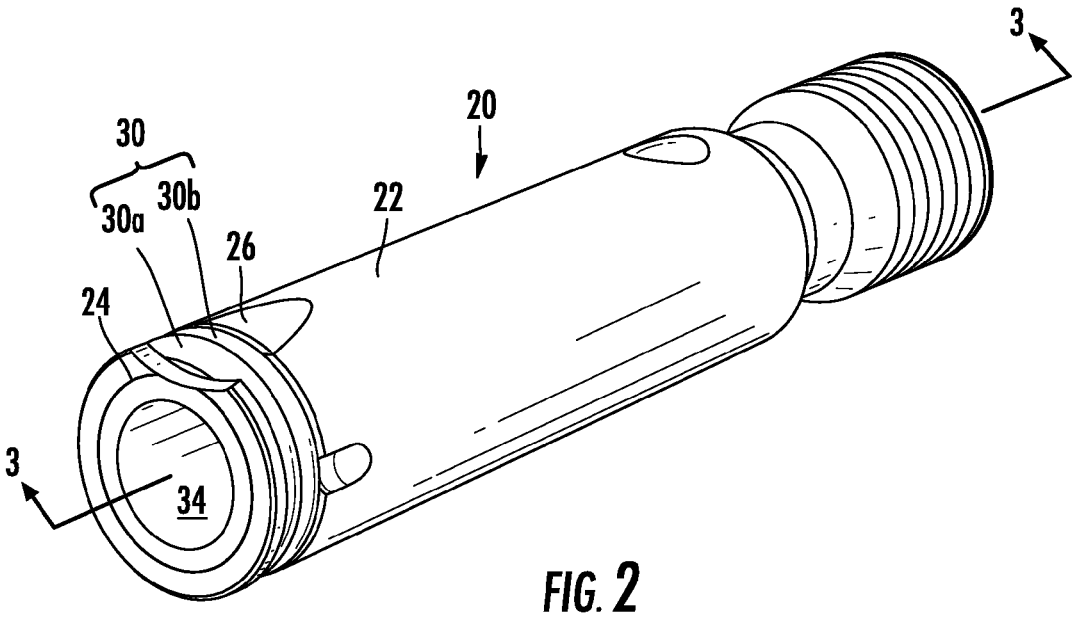
FIG. 2 is a perspective view of the bolt assembly of the present invention.
Figure 3:
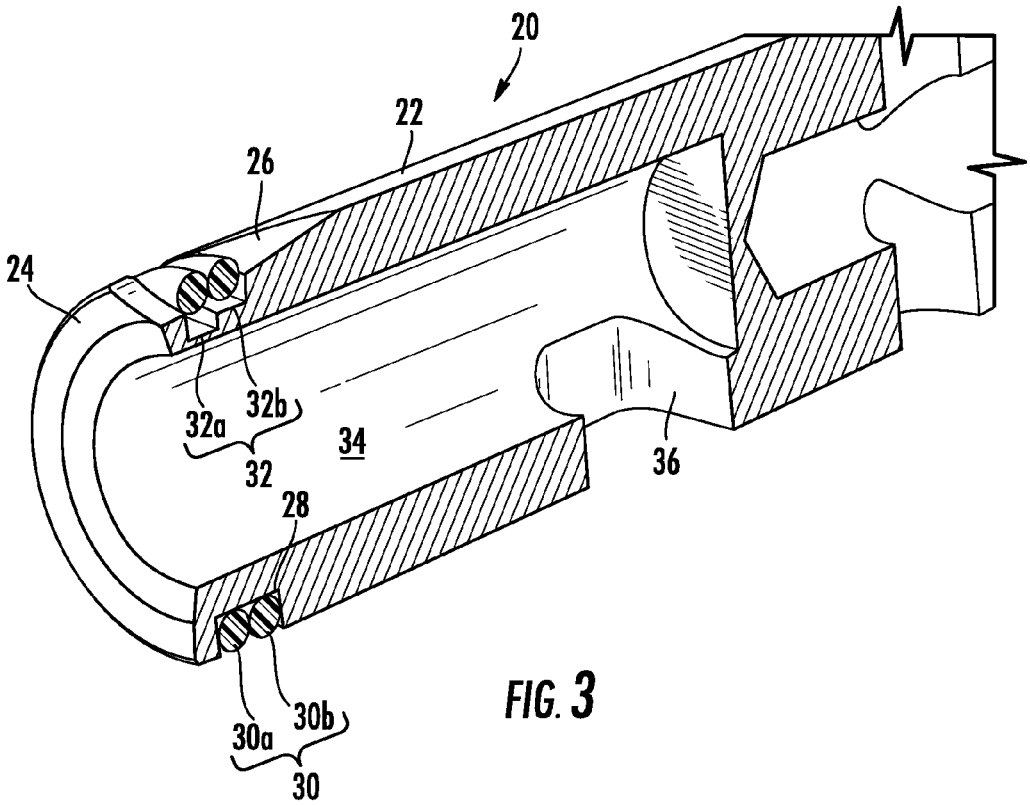
FIG. 3 is a cross-sectional view taken along Line 3-3 of FIG. 2.
Figure 4:
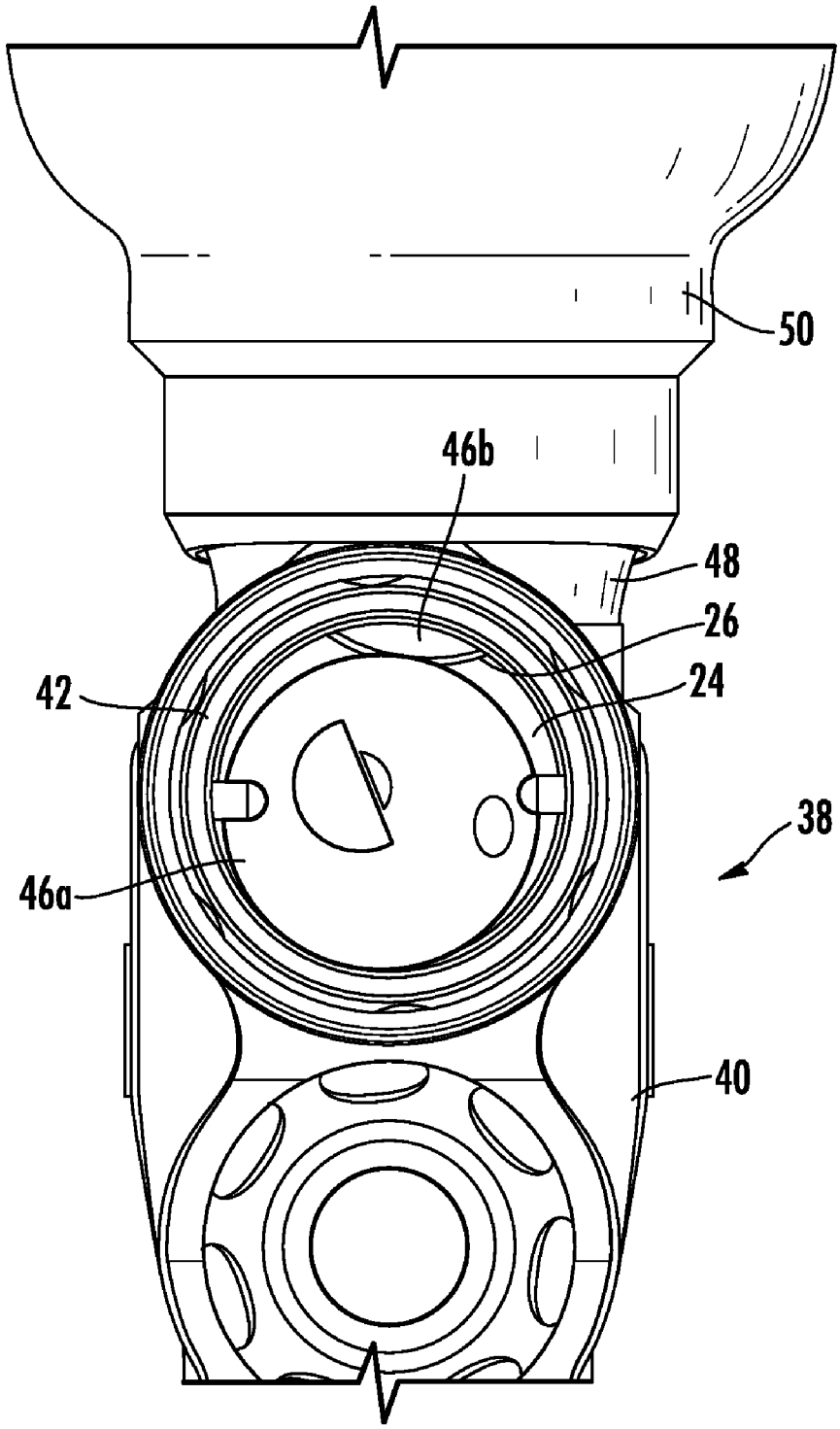
FIG. 4 is a front end view of a paintball marker with the bolt of the present invention.

Now referring to the drawings, FIGS. 2 and 3 depict a preferred embodiment of the improved bolt construction of the present invention while FIGS. 4 and 5 illustrate the improved bolt of the present invention in operation in the context of a pneumatic projectile launcher such as a paintball marker. It should be appreciated that while the term paintball marker will be used in the context of this description, this term is meant to encompass the broader general classification of pneumatic projectile launchers and is therefore not intended to limit the scope of the present disclosure.

Turning now to FIGS. 2 and 3, the improved bolt 20 of the present invention can be seen generally to include a body that has an outer surface 22, a front end defining a front face 24 and a tapered portion 26 of the outer surface 22 proximate the location at which paintballs enter the breech of the paintball marker as is defined by the orientation in which the bolt is operably received into a paintball marker as will be described in more detail below. In addition, the principal improvement in the bolt 20 of the present invention can be seen in that a portion of the outer surface 22 of the bolt 20 is tapered downwardly adjacent said front face 24 of the bolt 20 such that the downwardly tapered surface forms a projectile ramp 26. In the context of the present invention it is only required that a portion of the outer surface 22 and not the entire outer surface 22 be tapered downwardly towards the front face 24 of the bolt 20. It can further be seen that in the preferred embodiment, the tapered surface of the projectile ramp 26 is also formed as a concavely curved surface relative to the outer surface 22 of the bolt 20. More preferably, the concavely curved surface of the projectile ramp 26 is formed to have a radius of curvature that substantially corresponds to the radius of the outer surface of the projectile with which the bolt 20 will be used. In this manner, as will be described in more detail below, the projectile ramp 26 cradles and gently displaces a projectile away from the bolt 20 as the bolt 20 advances to the forward position.

As can best be seen in FIG. 3, the improved bolt 20 of the present invention also includes a seat 28 that is formed circumferentially in the outer surface 22 of the bolt 20 adjacent the front face 24 thereof. The seat 28 is configured to receive and retain a resilient seal 30 therein. The resilient seal 30 serves to seal the gap around the outer surface 22 of the bolt 20 as it is displaced into the forward position in order to prevent the compressed air upon its release from escaping rearwardly along the bolt 20. The resilient seal 30 may be any type or material that is known in the art as being suitable for such an application but is preferably at least one flexible O-ring in the context of the present invention. More preferably, the resilient seal is formed as two adjacent flexible O-rings 30*a*,30*b* as depicted in FIGS. 2 and 3 as the use of two O-rings 30*a*,30*b* has been found to provide good results to serve as a gas sealing membrane in the context of paintball markers. Further, in accordance with the present invention, O-rings 30*a*,30*b* were used, as they are readily available in a broad range of hardness and size. However, many different types of structures can be employed for in the context of forming a resilient seal 30 such as spring-loaded seals and other constructions known in the art.

It can also be seen in FIG. 3 that the seat 28 and the resilient seal 30 crosses over the surface of the projectile ramp 26 on the outer surface 22 of the bolt 20. In this regard, it is possible that in operation, the resilient seal 30 may result in clipping a second paintball as the bolt 20 reciprocates between a rearward and forward position. In order to avoid this result, the bolt 20 of the present invention includes a relief cut 32 positioned beneath the resilient seal 30 at the point where the seat 28 and resilient seal 30 cross over the surface of the projectile ramp 26. The relief cut 32 allows the resilient seal 30 to move downwardly into the seat 28 to a position that is nearly flush with the surface of the projectile ramp 26 thereby allowing the resilient seal 30 to be cleared from the path of the second projectile as the bolt 20 is moved to the forward position. It can be further seen that in the context of the present invention wherein the resilient seal 30 includes two O-rings 30*a*,30*b*, the relief cut 32 is formed to include two relief cuts 32*a*,32*b* wherein each of the relief cuts 32*a*,32*b* corresponds to each of the two O-rings 28*a*,28*b*. Further, the first or front relief cut 32*a* is formed to be deeper than the second or back relief cut 32*b* in a manner that allows the O-rings 28*a*,28*b* to be displaced downwardly into the relief cuts 32*a*,32*b* while remaining substantially flush with the surface of the projectile ramp 26.

The bolt 20 can be further seen to include a hollow central core 34 with a gas port 36 therein. The gas port 36 allows for a charge of compressed air to be discharged into the core 34 of the bolt 20 once the bolt 20 has been moved to a forward position wherein the gas charge serves to launch the projectile from the barrel of the paint ball marker.

Turning now to FIGS. 4 and 5, the improved bolt 20 of the present invention is shown installed in the context of a paintball marker 38. The paintball marker 38 can be seen to include a launcher body 40 that supports a barrel 42 and includes a breech 44 therein such that the breech 44 is configured to receive a projectile 46*a*. A projectile feed tube 48 can be seen connected to the launcher body 40 and in communication with the breech 44 therein. The projectile feed tube 48 is configured to sequentially feed a plurality of projectiles 46*a*, 46*b*,46*c* into the breech 44 one at a time. It can further be seen that as was the case in the prior art, a paintball 46*a* is gravity fed from a hopper (not shown), or the like, to the breech 44 while successive paintballs 46*b*,46*c* can be seen to be resting on each other during the loading process. In this regard a second paintball 46*b* can be seen to be touching a first paintball 46*a* that has already dropped into the breech 44 such that a portion of the second paintball 46*b* extends into the breech 44. The remaining details regarding the construction of paintball markers 38 and their breeches 44 are so well known in the art, they need not be discussed in further detail herein.

Figure 5A:
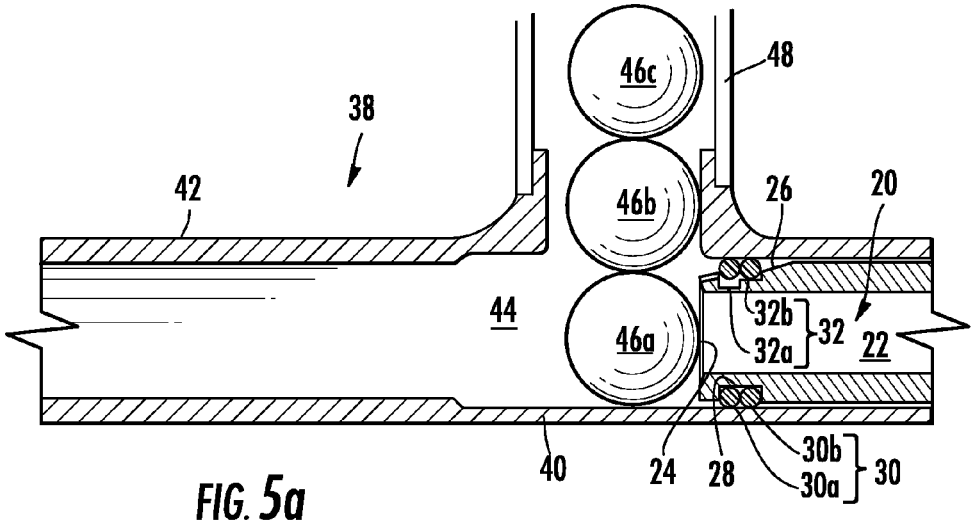
FIG. 5*a* is a cross sectional view of a paintball marker with the bolt of the present invention in a rearward position.
Figure 5B:
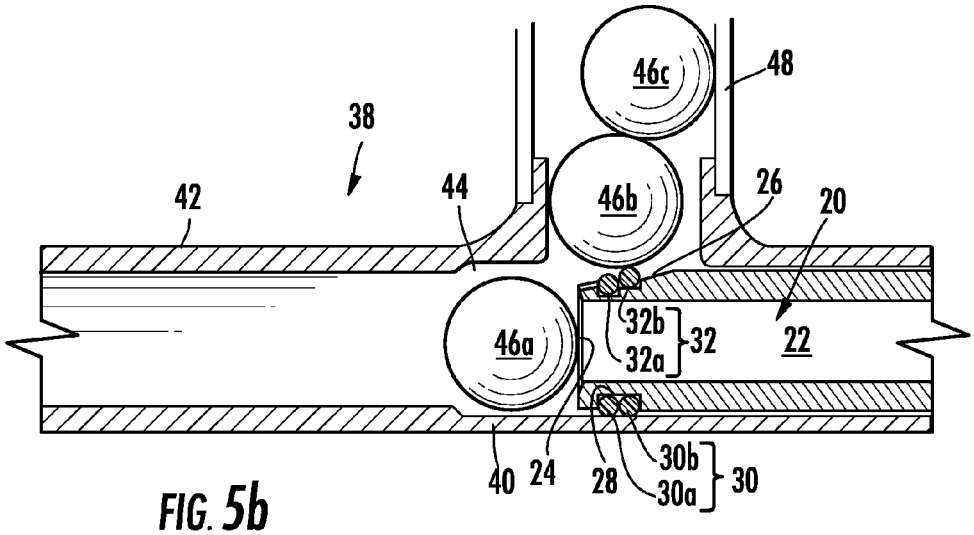
FIG. 5*b* is a cross sectional view of a paintball marker with the bolt of the present invention traveling to a closed position.
Figure 5C:
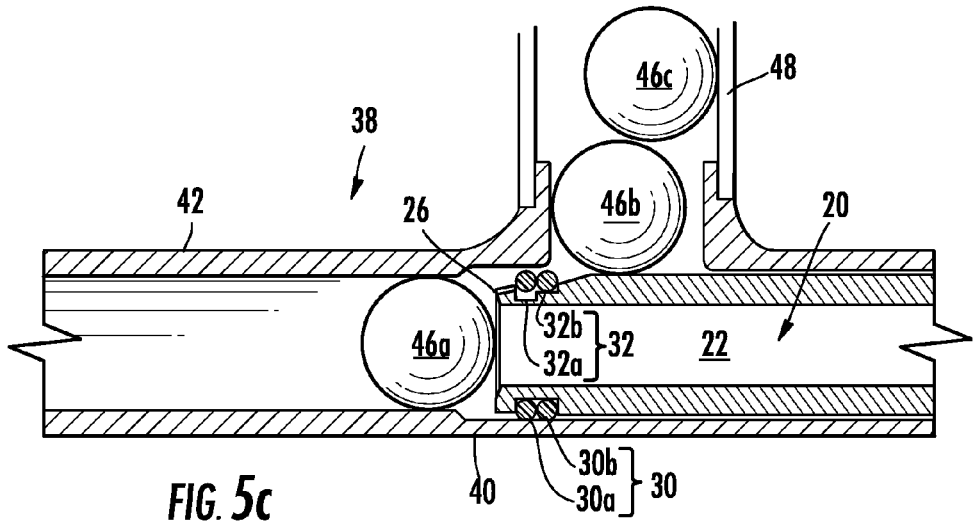
FIG. 5*c* is a cross sectional view of a paintball marker with the bolt of the present invention in a fully closed position.

The bolt 20 of the present invention is positioned within the breech 44 such that the bolt 20 is movable between a rearward position and a forward position. With the bolt 20 in the rearward position, a first projectile 46*a* can enter the breech 44 from the projectile feed tube 48 as is depicted in FIG. 5*a*. As the bolt 20 is displaced to the forward position as depicted in FIG. 5*b* the first projectile 46*a* is displaced to a launching position. More importantly, as described above, the bolt 20 includes a front face 24 and an outer surface 22 wherein a portion of the outer surface is tapered downwardly adjacent the front face 24 forming a projectile ramp 26. FIG. 4 shows that the surface of the projectile ramp 26 is concavely curved and has a radius that is substantially the same as the radius of the paintballs 46*a*,46*b* employed in the paintball marker 38. It can be seen that as the bolt 20 advances, the front face 24 displaces the first paintball 46*a*, now positioned within the breech 44, forward to the barrel 42 to ready the first paintball 46*a* for launch. In addition, rather than impacting the side of the second paintball 46*b* with the leading edge of the bolt 20, as was the case in the prior art, the projectile ramp 26 contacts a lower portion of the exterior surface of the second projectile 46*b* in a manner that cradles the second paintball 46*b* and displaces it back up and into the feed tube 48 and out of the way of the reciprocating bolt 20. In this manner, the projectile ramp 26 on the bolt 20 of the present invention greatly reduces the possibility of damaging or clipping the second paintball 46*b*.

It should be appreciated to one skilled in the art that while the figures depict an arrangement wherein the paintballs 46*a*, 46*b*,46*c* are fed into the breech 44 from the top and therefore the projectile ramp 26 is formed on the top of the outer surface 22 of the bolt 20, other configurations also fall within the present disclosure. For example, the projectile feed tube 48 may be slightly offset from the top center portion of the breech 44 or may be positioned to feed into the side of the breech 44. In any of these cases, the teachings of the present invention are still applicable and the position of the projectile ramp 26 on the bolt 20 only need be reoriented to a position that is proximate the location where the feed tube 48 meets the breech 44.

Referring again to FIGS. 5*a*, 5*b* and 5*c*, the leading edge portion of the bolt 20 includes the circumferential seat 28 and resilient sealing member 30 as discussed above. Further, it can be seen that the seat 28 includes relief cutouts 32*a*,32*b* at the location wherein the seat 28 crosses the projectile ramp 26. The position of the projectile ramp 26 and the relief cutouts 32*a*,32*b* are positioned to correspond to the position of the second paintball 46*b* as it resides in the feed tube 48 awaiting transfer to the breech 44. As a result, the second paintball 46*b* that is being forced into contact with the first paintball 46*a* within the breech 44 by the force feed loader 50 is able to ride upwardly along the projectile ramp 26 being displaced back into the feed tube 48 as the bolt 20 cycles forward to fire the first paintball 46*a*. It can also be seen that the resilient seal 30*a*,30*b* is provided with room, as a result of the relief cuts 32*a*,32*b*, to downwardly flex out of the path of the second paintball 46*b* (shown at FIG. 5*b*). This allows the second paintball 46*b* to be gently guided up the shallow projectile ramp 26 and out of harms way to avoid bursting and jamming. Once the projectile ramp 26 portion of the bolt has cycled past the second paintball 46*b*, the resilient seal 30*a*, 30*b* is allowed to expand to its previous shape (shown at FIG. 5*c*) and back into a sealing position allowing the bolt 20 to fully seal in the front of the breech 44 as the first paintball 46*a* is being fired. It should also be noted that the flexible portion of the resilient seal 30*a*,30*b* need to only be in the region where the resilient seal 30*a*,30*b* crosses the projectile ramp 26 and has a possibility of contacting the second paintball 46*b*. Such flexibility further serves to urge the second paintball 46*b* away from the moving bolt 20 in a cushioned manner. In terms of a method, the present invention discloses a method of operating a pneumatic projectile launcher 38 that includes a body 40 having a breech 44 therein for receiving a projectile. A projectile feed tube 48 is connected to the launcher body 40 and is configured to sequentially deposit a plurality of projectiles 46*a*,46*b*,46*c* into the breech 44 one at a time. A bolt 20 is provided and movably positioned within the breech 44 wherein the bolt 20 includes a front face 24 and an outer surface 22 such that the outer surface 22 proximate the feed tube 48 is tapered downwardly adjacent its front face 24 to form a projectile ramp 26. The bolt 20 is displaced to a rearward position to allow a first projectile 46*a* to enter the breech 44 from the projectile feed tube 48. The bolt 20 is then displaced to a forward position wherein the front face 24 of the bolt 20 displaces the first projectile 46*a* to a launch position and the projectile ramp 26 displaces a second projectile 46*b* that is positioned within the feed tube 48 and in contact with the first projectile 46*a* back into the projectile feed tube 48. In this manner, the first projectile 46*a* is readied for launch while the second projectile 46*b* is protected from clipping or bursting.

It can therefore be seen that the improved bolt assembly 20 for a paintball marker 38 of the present invention is unique and novel as compared to the prior art as it is formed in an manner that prevents the bolt 20 from clipping or otherwise damaging a second incoming paintball projectile 46*b* as the bolt 20 reciprocates forward to ready a first paintball 46*a* that is already loaded into the breech 44 in preparation for launch. As a result, a paintball marker 38 that uses the bolt 20 construction of the present invention operates in a more reliable manner while allowing for faster cycle times. For these reasons, the present invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A pneumatic projectile launcher, comprising:

a launcher body including a breech therein for receiving a projectile;

a projectile feed tube connected to said launcher body and configured to sequentially feed a plurality of projectiles into said breech one at a time;

a cylindrical bolt positioned within said breech, said bolt movable between a rearward position wherein a first projectile can enter said breech from said projectile feed tube and a forward position wherein said first projectile is displaced to a launching position, said bolt having a front face and an outer surface wherein a portion of said outer surface that is positioned proximate said projectile feed tube is tapered downwardly adjacent said front face forming a projectile ramp;

a seat formed around said bolt adjacent said front face said seat including a relief cut where said seat crosses said projectile ramp; and a resilient seal positioned within said seat, said relief cut allowing said resilient seal to be displaced downwardly by said second projectile as said bolt moves to said forward position.

2. The pneumatic projectile launcher of claim 1, wherein said projectile ramp has a concavely curved surface relative to said outer surface of said bolt, said concavely curved surface having a radius of curvature that substantially corresponds to a radius of an outer surface of said plurality of projectiles.

3. The pneumatic projectile launcher of claim 1, wherein a second projectile within said projectile feed tube is in contact with said first projectile within said breech when said bolt is in said rearward position, wherein said front face of said bolt displaces said first projectile to said launching position and said projectile ramp displaces said second projectile back into said projectile feed tube as said bolt moves to said forward position.

4. The pneumatic projectile launcher of claim 1, wherein said seal is an O-ring.

5. The pneumatic projectile launcher of claim 1, wherein said seal is two O-rings positioned adjacent to one another within said seat.

6. The pneumatic projectile launcher of claim 5, said seat further comprising:

two relief cuts within said seat where said seat crosses said projectile ramp, a first of said relief cuts positioned below a first of said two O-rings and a second of said relief cuts positioned beneath a second of said two O-rings, said first relief cut being deeper than said second relief cut, said relief cuts allowing said O-rings to be displaced downwardly into said relief cuts by said second projectile as said bolt moves to said forward position.

7. A method of operating a pneumatic projectile launcher, having a launcher body including a breech therein for receiving a projectile and a projectile feed tube connected to said launcher body and configured to sequentially deposit a plurality of projectiles into said breech one at a time, said method comprising the steps of:

providing a cylindrical bolt having a front face and an outer surface wherein said outer surface that is positioned proximate said feed tube is tapered downwardly adjacent said front face forming a projectile ramp, a seat formed around said bolt adjacent said front face said seat including a relief cut where said seat crosses said projectile ramp, and a resilient seal positioned within said seat;

said bolt being movably positioned within said breech between a rearward position and a forward position;

moving said bolt to said rearward position wherein a first projectile can enter said breech from said projectile feed tube;

moving said bolt to said forward position wherein said front face of said bolt displaces said first projectile to said launching position and said projectile ramp displaces a second projectile that is positioned within said feed tube and in contact with said first projectile back into said projectile feed tube , said relief cut allowing said resilient seal to be displaced downwardly by said second projectile as said bolt moves to said forward position.

8. The method of claim 7, wherein said projectile ramp has a concavely curved surface relative to said outer surface of said bolt; said concavely curved surface having a radius of curvature that substantially corresponds to a radius of an outer surface of said plurality of projectiles.

* * * * *